United States Patent [19]

Fang

[11] Patent Number: 4,772,055

[45] Date of Patent: Sep. 20, 1988

[54] AUXILIARY LOCK WITH AN EXTENSIBLE DEVICE

[75] Inventor: Yau C. Fang, Chiayi City, Taiwan

[73] Assignee: Posse Lock Manufacturing Co., Ltd., Chiayi City, Taiwan

[21] Appl. No.: 893,650

[22] Filed: Aug. 6, 1986

[51] Int. Cl.[4] ..... E05C 21/02

[52] U.S. Cl. ..... 292/337; 292/DIG. 60; 292/1; 292/167

[58] Field of Search ..... 292/337, 1, 169.13, 292/169.14, DIG. 60, 167

[56] References Cited

U.S. PATENT DOCUMENTS 3,823,585 7/1974 Spon ..... 292/169.14 X
4,489,576 12/1984 Mullich et al. ..... 292/DIG. 60 X
4,662,665 5/1987 Lin ..... 292/337 X

*Primary Examiner*—Richard E. Moore
*Attorney, Agent, or Firm*—Holman & Stern

[57] ABSTRACT

An auxiliary lock has a base, an extending shell and a linking arm that, through holes, slots and projections disposed thereon connect adjustably together for lengthening or shortening the assembly while maintaining constant the length of the dead bolt exposed out of a cylinder into a faceplate.

3 Claims, 4 Drawing Sheets

AUXILIARY LOCK WITH AN EXTENSIBLE DEVICE

BACKGROUND OF THE INVENTION

Field Of The Invention

This invention relates to auxiliary locks of the type having a dead bolt extending through a faceplate for engagement with a locking hole.

An auxiliary lock is an extra reinforcing device for safety. When fixing this lock in a door, a long latitudinal groove needs to be cut on the side surface of the door so as to fit the lock in, and a turning hole then is cut in the front surface of the door to fit with the intersecting crossed hole of the lock. The "crossed hole" is a rotatable member having a cross-shaped opening.

Nowadays, locks, in order to meet different requirements depending on the structure of a door, are usually manufactured into two sizes—so called 60 mm and 70 mm. therefore manufacturers have to make auxiliary locks of different sizes, retailers are obliged to devote more space for storing them, and besides, buyers will feel puzzled how to select them.

SUMMARY OF THE INVENTION

The object of this invention is to provide an auxiliary lock wherein the dead bolt is adjustable in its length, by means of making the extending shell move outside of the base, and changing the combining point of the dead bolt with other part so that the distance of the dead bolt exposing out of the faceplate can be kept constant.

BRIEF DESCRIPTION OF THE DRAWINGS

The invention will now be described in detail with reference to the accompanying drawings wherein.

DETAILED DESCRIPTION OF THE INVENTION

Figure 1:
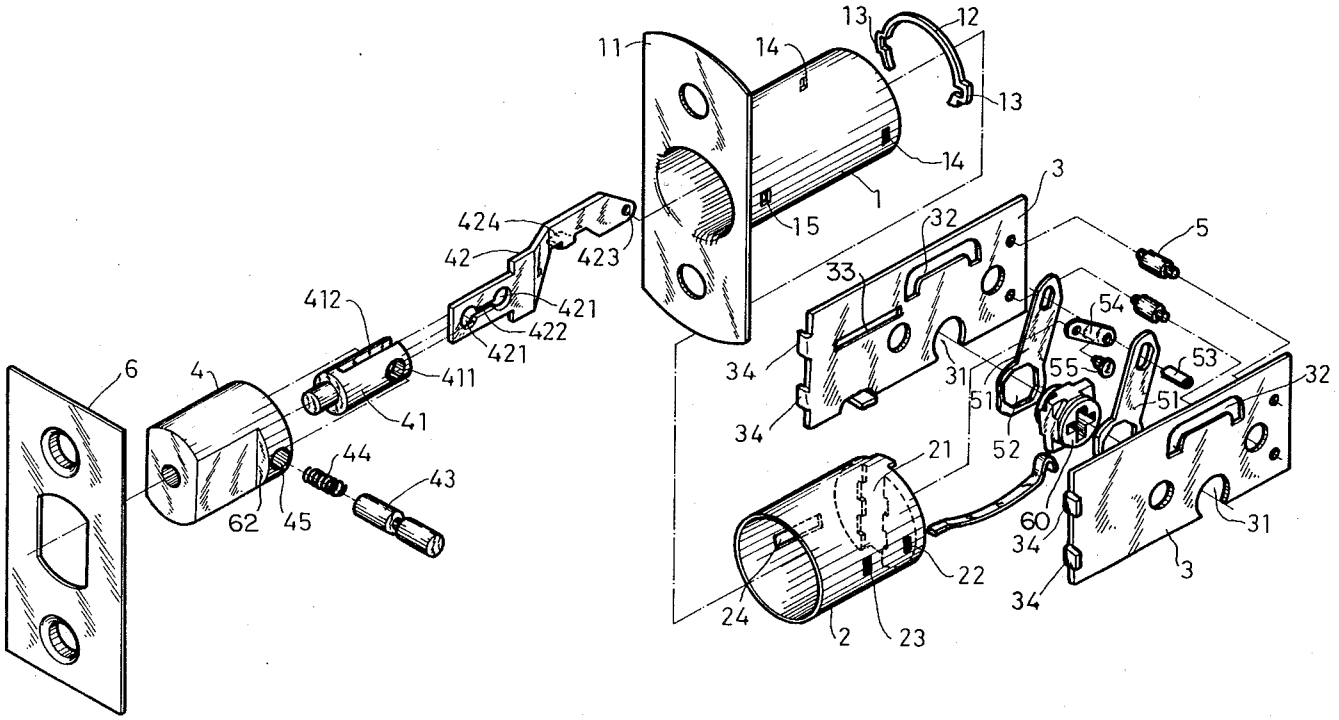
FIG. 1 is an exploded perspective view of the auxiliary lock of the present invention.

The present invention includes a base 1, an extending shell 2, assembling plates 3, a dead bolt 4, moving accessories 5 and a fixing plate 6.

In a conventional auxiliary lock such as shown in FIG. 1 each of the moving accessories 5 combines with the assembling plates 3, which hook at the base 1. By turning the swing rod 51 of the moving accessories, the linking arm 42 moves making the dead bolt 4 extend out or stay inside of the faceplate 11 of the base 1.

The present invention has the same functions as the above known art except that it has the assembling plates 3 assembled at the bottom of the extending shell 2 and that the linking arm 42 combines with the dead bolt 4 to become adjustable in length.

The base 1 is combined with a faceplace 11 as a single part of the cylinder. A semicular spring 12 is to be inserted into the cylinder and has two projections 13 at its two sides which will hook with and extend out of the holes 14. The cylinder itself has another hole 15.

The extending shell 2 can be put outwards into the cylinder. At the bottom of the extending shell 2 is an assembling opening 21 which is for receiving the hooks 34 of the assembling plates 3 to combine plates 3 with the extending shell.

Two key holes 22, 23 at the same level enable the projections 13 of the spring 12 to extend out through the key holes 14 of the base 1; in addition, a slot 24 cut at the other side of the extending shell 2 enables the projection 13 on the other side to extend out through the hole 14 on the other side and extends straight into slot 24 so as to restrict the shell 2 to move along the cylinder in a straight line.

The assembling plates 3 and the moving accessories 5 have the same structures as the known art, and their function is based on the following principles.

An opening 52 formed in each swinging rod 51 is to fit with a rotating member 60 whose oppositely extending cylindrical projections are disposed in the holes 31 of the assembling plates 3. When the knob is rotated, the swinging rods will be successively motivated to rotate and a pin 53 combined with the swinging rods 51 is able to move along slots 32 in the assembling plates. Then, via a linking plate 54 and a pin 55 the swinging rods 51 and a linking arm 42 are connected together so that the linking arm 42 can be moved by rods 51.

Figure 2:
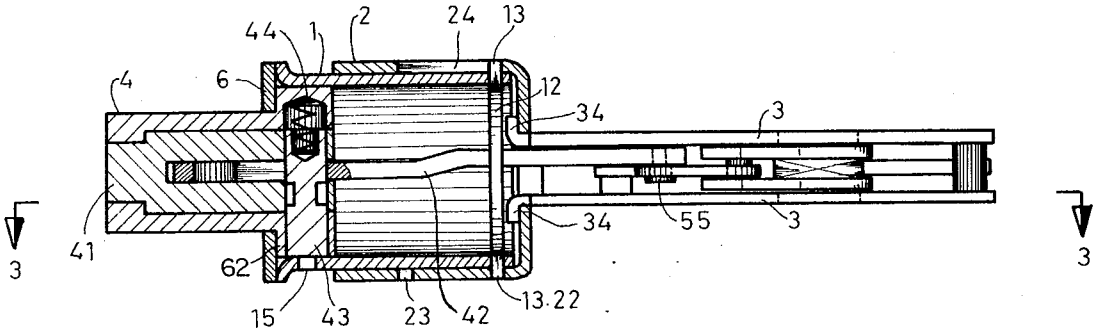
FIG. 2 is a cross sectional view take along line 2—2 of 3.
Figure 3:
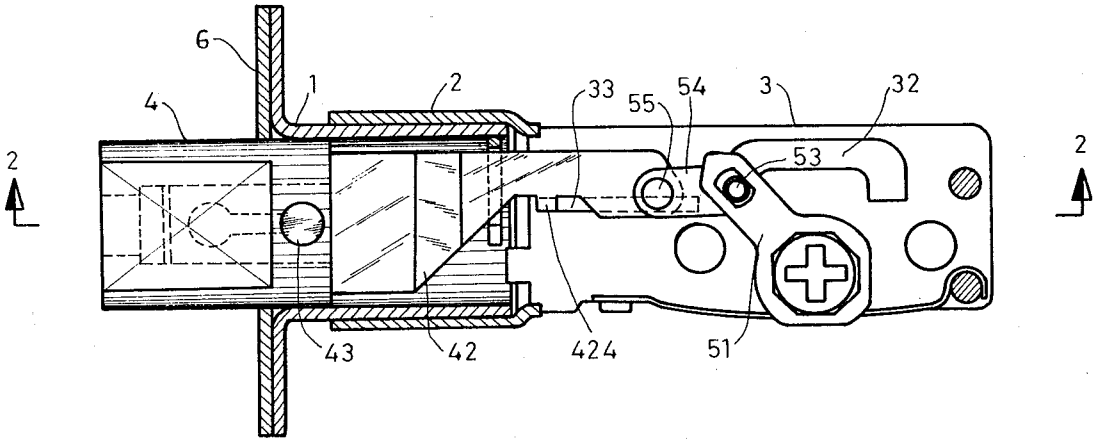
FIG. 3 is a cross sectional view take along line 3—3 of 2.

The dead bolt 4 receives in a central hole therein a reinforcing rod 41 as shown in FIGS. 1, 2, and is connected with it by an H-shaped, i.e. in cross section, pin 43, which is inserted into the dead bolt 4 after inserting a spring 44 into it.

The reinforcing rod 41 has a hole 411 and a straight slot 412 which can receives the end of the linking arm 42 so as to enable the reinforcing rod 41 and the linking arm 42 to be placed into the dead bolt 4 and bolted together with it by inserting the spring 44 and H-shaped pin 43 through a hole 45 in the dead bolt 4.

The linking arm 42 has two holes 421 for receiving the H-shaped pin 43, and a slot 422 cut through between the holes 421 which allows the reduced diameter part of the H-shaped pin 43 to pass through it so that the pin 43 can be alternately positioned in either of the holes 421. The connecting hole 423 of the linking arm 42 is connected with the linking plate 54 by the pin 55. A projecting tab 424 of the linking arm 42 engages in the slot 33 of one of the assembling plates 3 to guide the linking arm 42 in a straight line.

After all the parts are assembled faceplate 6 restricts outward movement of dead bolt 4 from base 1 and by engagement with shoulders 62 so that part of dead bolt 4 extends out but the dead bolt is retained in the assembly.

Figure 7:
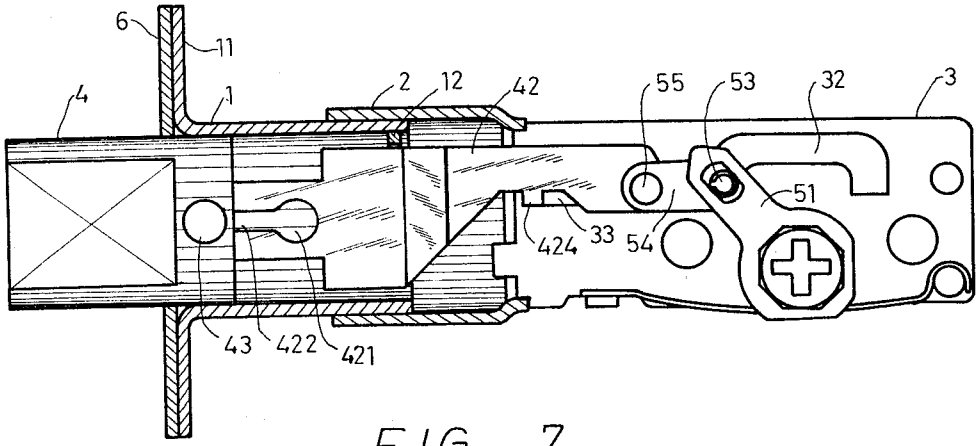
FIG. 7 is a view similar to FIG. 5 of the present invention adjusted to the long size.

FIGS. 2, 7 show that the assembly of this new invention is capable of having its length adjusted. The H-shaped pin 43 is locked in the inward hole 421 of the linking arm 42 and urged by the spring 44 to retain its thicker part in the inward hole 421. Then, when the swinging rod 51 is turned clockwise, the linking arm 42 is moved to the right, and, via the pin 43, the dead bolt 4 is successively pulled to move inwardly.

Figure 4:
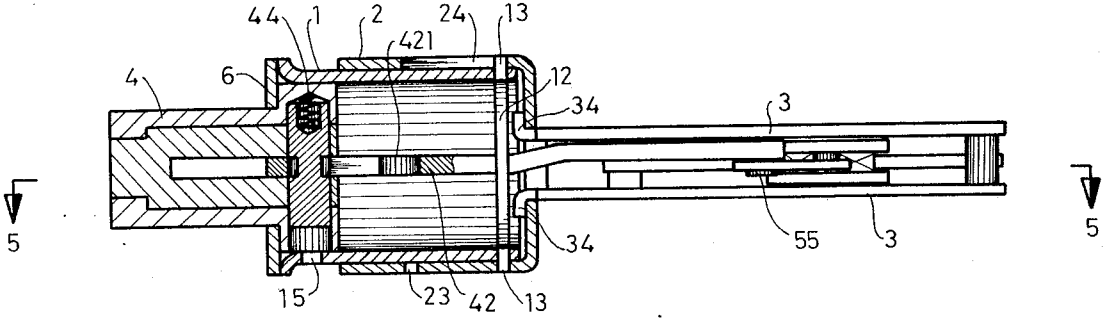
FIG. 4 is a cross sectional view take along lines of FIG. 4.
Figure 5:
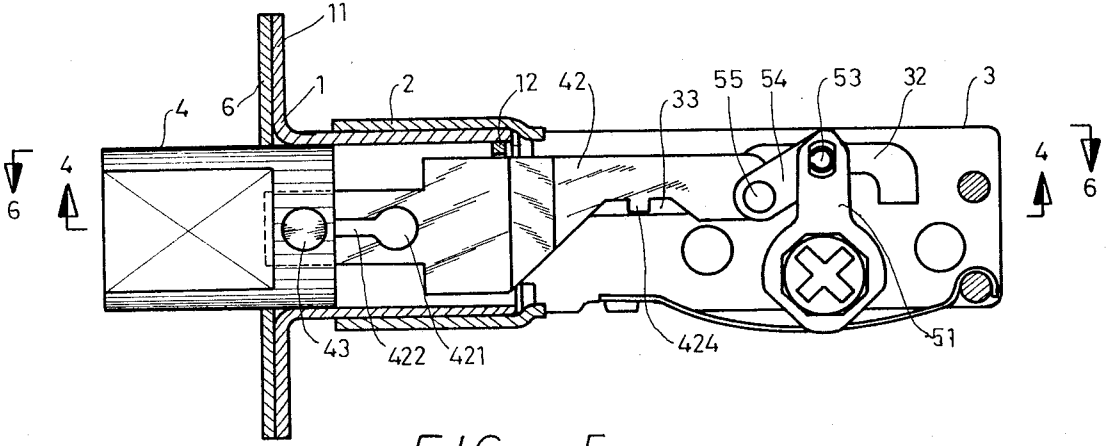
FIG. 5 is a cross sectional view take along lines of FIG. 4.
Figure 6:
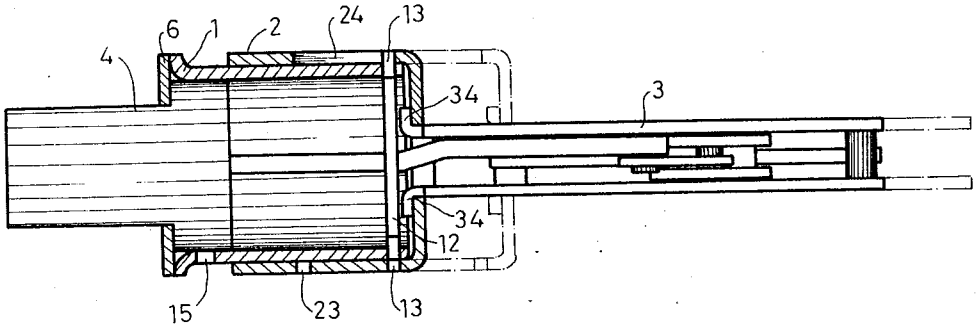
FIG. 6 is a cross sectional view take along lines of FIG. 7.

FIGS. 4, 5 show how to lengthen the assembly. First, with an unhooking tweezer or a sharpened metal instrument inserted through hole 15 pin 43 is pressed inwardly against spring 44 to enable the thinner part of the pin 43 in ward hole 421 to engage in slot 422 of the linking arm 42, and, at the same time, turn the swinging rods 51 clockwise to make the outward hole 421 fit with pin 43; then remove the pressure on pin 43. Next, as shown in FIGS. 6, 7 through the hole 22 press inwardly the projection 13 of the spring 12 so that the extending shell 2 becomes unlocked and able to be extended outwardly making the projection 13 of the spring 12 to meet with and to go into the hole 23 of the extending shell 2 so as to again fix the shell 2 in the extended position. By means of the above manipulation, the distance between the opening 52 of each swinging rod 51 and the faceplate 11 of the base 1 is lengthened.

Of course, if the relatively short length is desired, the reverse order of the above actions can attain it.

In summary, via the inward or outward motion of the extending shell 2 along the base cylinder and the connection of the linking arm 42 with the dead bolt 4, the distance between the openings 52 and the faceplate 11 can be altered to become relatively short or long and the length the dead bolt extends out of the faceplate 11 is retained constant so that the present lock can selectively fit with any door.

I claim:

1. An auxiliary lock with an extensible portion comprising:

a cylinder;

a faceplate attachable to said cylinder;

an extensible shell surrounding said cylinder;

two oppositely-disposed first holes in said cylinder adjacent one end thereof;

a second hole in said cylinder adjacent the other end thereof adjacent said faceplate;

a semi-circular spring insertable into said one end of said cylinder and having two outwardly-extending projections thereon for engagement in and extending through said first holes;

an axially-extending slot in said shell for receiving said extended portion of one of said projections for sliding engagement therewith;

third and fourth holes axially spaced in said shell and oppositely disposed with respect to said axially-extending slot for releasably receiving the other of said projections when said shell is in retracted and extended positions, respectfully, spaced substantially the length of said axially-extending slot with respect to said cylinder for releasably retaining said sleeve in said retracted and extended positions on said cylinder;

two spaced assembling plates having outwardly-extending hooks on one end thereof;

an end portion on said shell extending inwardly over said one end of said cylinder;

an opening in said end portion for receiving said hooks on said assembling plates for connecting said assembling plates to said shell;

oppositely-disposed holes in said assembling plates;

a rotatable member disposed between said assembling plates and having cylindrical projections on opposite ends thereof rotatably engageable in said holes in said assembling plates;

at least one swing rod mounted on said rotating member for rotation therewith between said assembling plates;

said at least one swing rod having a radially outer end with respect to said rotatable member;

an aperture in said radially outer end of said at least one swing rod;

a pin member extending through said aperture between said assembling plates;

oppositely-disposed slots in said assembling plates for slidably receiving opposite ends of said pin member;

a connecting link between said outer end of said at least one swing rod and one of said assembling plates;

a hole in one end of said connecting link for receiving said pin member therethrough for rotatably connecting said connecting link to said at least one swing rod;

a further slot in one of said assembling plates;

a further hole in the other end of said connecting link;

a connecting pin extending through said further hole in said connecting link;

a linking arm between said assembling plates and partly disposed within said shell and said cylinder and having a hole at one end thereof for receiving in rotatable engagement said connecting pin for connecting said linking arm to said connecting link;

a projecting tab on said linking arm slidably engaging in said further slot in said one assembling plate;

a hollow dead bolt slidably received within said cylinder;

a reinforcing rod having one end insertable into said dead bolt and an axial slot in the other end for receiving said linking arm;

spaced holes in the other end of said linking arm and a slot in said linking arm between and connecting said spaced holes;

a hole in said dead bolt adjacent the inner end thereof remote from said faceplate;

a hole in said reinforcing rod extending through said axial slot in said reinforcing rod adjacent one end thereof so that when said reinforcing rod is inserted into said dead bolt and said other end of said linking arm is inserted into said axial slot in said reinforcing rod, said holes in said dead bolt and said reinforcing rod and said other end of said linking arm are aligned;

a cylindrical connecting pin insertable into said aligned holes;

a peripheral slot in said cylindrical connecting pin producing a reduced diameter portion on said cylindrical connecting pin engageable with said slot between said two holes in said other end of said linking arm so that said linking arm can be adjusted with respect to said dead bolt and said cylindrical connecting pin is engageable in either of said two holes by moving said reduced diameter portion in said slot between said two holes in the linking arm;

a hole in said faceplate for slidably receiving said dead bolt; and cooperating means on said faceplate and said dead bolt for restricting the movement of said dead bolt outwardly with respect to said faceplate.

2. An auxiliary lock as claimed in claim 1 and further comprising:

spring means in said hole in said dead bolt for resiliently urging said cylindrical connecting pin in a position where said reduced diameter portion is disengaged from said slot between said holes in said other end of said linking arm; and said cylindrical connecting pin being engageable in the assembled position at one end thereof with said cylinder adjacent said second hole in said cylinder so that said cylindrical connecting pin can be moved against the force of said spring means by means inserted through said second hole into the position of engagement of said reduced diameter portion on said cylindrical connecting pin with said slot between said two holes in said linking arm.

3. An auxiliary lock as claimed in claim 2 wherein: said spring means comprises a helical coil spring; and a bore is provided in one end of said cylindrical connecting pin for receiving one end portion of said helical coil spring

* * * * *